United States Patent [19]

Salina et al.

[11] 4,442,395

[45] Apr. 10, 1984

[54] PUMP FAILURE PROTECTION FOR LIQUID TRANSMISSION PIPELINES

[75] Inventors: Louis E. Salina; Joseph E. Lescovich, both of Bridgeville, Pa.

[73] Assignee: GA Industries Inc., Mars, Pa.

[21] Appl. No.: 243,878

[22] Filed: Mar. 16, 1981

Related U.S. Application Data

[62] Division of Ser. No. 948,040, Oct. 2, 1978, Pat. No. 4,273,513.

[51] Int. Cl.[3] ..... H02J 7/10

[52] U.S. Cl. ..... 320/48; 340/636

[58] Field of Search ..... 320/48; 340/635, 636

*Primary Examiner*—William M. Shoop
*Assistant Examiner*—Anita M. Ault
*Attorney, Agent, or Firm*—Parmelee, Miller, Welsh & Kratz

[57] ABSTRACT

In order to more effectively control the operation of surge valves in pumping stations through relatively long pipelines where liquid is pumped to an elevated discharge circuit and avoid excessive waste of water, where there is provided an electric solenoid to effect opening and subsequent closing of the surge valve and an electric circuit that responds to abnormal conditions which will result in a pressure surge of water with the unscheduled pump stoppage due to mechanical or electrical failure. This circuit operates to open the solenoid valve in time for the surge valve to open before the actual pressure surge of water arrives and closes after the surge has spent at least most of its force, so that liquid will be spilled for only a safe period of time. At the same time, the circuit will effect the successive display of pilot lights to indicate its condition at any time. There are also provided battery charging and indicating circuits to meet the charging requirements of the battery under different conditions to which it is subjected and also display battery circuit condition indicating lights. Provision is made for indicating the condition of a battery circuit which provides energy in the event of power failure to assure proper operation, along with a power supply circuit, and there are modifications to meet special conditions.

7 Claims, 10 Drawing Figures

BATTERY CONDITION INDICATOR

PUMP FAILURE PROTECTION FOR LIQUID TRANSMISSION PIPELINES

This is a division of application Ser. No. 948,040 filed Oct. 2, 1978 now U.S. Pat. No. 4,273,513.

This invention relates to the transfer of liquids, most commonly water and sewage lines where liquids in large volumes are pumped from a lower to a higher elevation through relatively long pipelines. In these and other similar systems heavy damage may result where there is an unexpected power failure or mechanical breakdown of a pump.

Generally, and almost exclusively, pumping systems of the kind to which this invention is applicable employ more than a single pump and usually more than two pumps in parallel to meet variable output demands or input supply but keep uniform pressure in the pipeline, which is preferable to a single large pump, but this invention is applicable to systems having one or more pumps. The expression "last pump" in the case of a system having only one pump will apply to the single pump, and also the use of the plural "pumps" may mean such single pump.

Where the system is operating normally and for some reason the pump or the last pump stops, there is an initial drop in pressure in the pump header as the large volume of liquid ahead continues to move through the pipe but the loss of pressure sets up a shock wave that travels through the liquid at the speed of sound in water, that is, around 4000 feet (1200+ meters) per second. Reaching the remote terminal of the pipeline, a pressure wave returns, often of destructive force, which may damage the pipeline and its supports or break the pumps. For this reason it is the usual practice to connect a surge valve into the header at the pumping station arranged to open when such failure of the pumps occurs.

Generally, a surge valve has a valve closing the inlet to the valve casing while the casing has a normally unrestricted outlet. The valve element is slidable in the valve chamber with its end remote from the seat of larger area than its seat on the inlet, this end of larger area being exposed to the interior of a pressure chamber which also communicates with the pump header. As long as the pressure in the pressure chamber is equal to the header pressure tending to open the valve, the valve will remain closed or seated because of the larger area in the pressure chamber. If the pressure drops in the header, a pilot valve will operate to release the pressure in the pressure chamber to atmospheric pressure whereupon the valve will lift from its seat and allow a free outflow of water from the header through the surge valve and pipeline to waste, thereby protecting the pump and pipeline from the impact of the pressure surge. Heretofore a hydraulic pilot valve was provided to open the surge valve when the unscheduled stopping of the pumps reduced hydraulic pressure in the surge valve pressure chamber.

A drawback to this arrangement is that in a very long pipeline the hydraulic pilot valve will open well before the return surge reaches the pumping station where, in other cases and with shorter pipelines, the surge may return before the hydraulic pressure valve will have opened sufficiently to effect full opening of the surge valve, or perhaps no opening of the surge valve will have happened whereupon the surge valve was unprepared to meet the pressure surge in time to effectively effect the desired relief, although a pressure relief valve was also provided.

It has heretofore been proposed to replace the hydraulic pressure relief valve above referred to with a solenoid operated relief valve for opening the surge valve and to substitute a pressure switch that will energize the solenoid valve to open fully almost instantaneously when the pump discharge pressure lowers due to sudden abnormal shutdown of pump but which, of course, does not happen with the gradual controlled shutdown of the pumps.

The present invention utilizes such a solenoid and pressure switch but in conjunction with a control circuit means designed, but not necessarily required, to be contained within a single conveniently located box or housing and arranged to anticipate the pressure surge and assure the surge valve being open at the required time and to effect gradual closing of the surge valve after a predetermined time interval adequate for the surge valve to have relieved the pressure surge. This control circuit means is energized from the same power source as the pumps but includes a battery which functions if the power to the pumps fails, utilizing a unique battery charging circuit with a nickel cadmium battery and a battery condition indicator that will keep the operator informed as to the battery and charger condition and even provide warning of a blown fuse or defective circuit or battery. Adjustable time delay relays in the circuit sequences operations, as hereinafter described in detail, and in such manner that after there has been an operation of the surge valve and the circuit is about to re-arm itself for the next emergency, and with the restoration of power to the circuit, only a light emitting diode on the battery condition indicator will show a light emitting diode being lighted. If, at this time, the pressure switch for the surge valve should be closed but no pump should be operating, an amber panel light will start flashing. If now a pump is started, the amber panel light will stop flashing and remain constantly lit.

The starting of the pump or pumps will result in the first time delay relay starting to run. At the preset time interval a control relay will de-energize the amber panel light and a green panel light will be steadily lit. The elapsed time to this point will ordinarily display the lighting of the green light for sufficient time that minor startup pulsations which could result in opening the pressure switch (which will previously have been closed by the head of water remaining in the pipeline after the brief opening of the surge valve) will be ineffective to cause a surge valve opening. Usually a timer allowing a period up to 300 seconds will be adequate for this startup.

The "timing out" of the first time delay relay at this point establishes a circuit to a second time delay relay which in its initial condition will have no immediate effect, but if there is a power failure or an opening of the pressure switch for some other cause, the first time delay relay loses its ground or negative circuit, establishing a circuit through the solenoid switch to cause opening of the surge valve, extinguishing the green panel light, lighting a red panel light warning that a pressure surge is to be anticipated and setting in motion time delay relay No. 2. This assures that the surge valve will remain open for a predetermined period of time. At the end of this time, time delay relay No. 2 will de-energize the circuit completely. This will also open the circuit to the control relay which, however, will not occur immediately due to an off-delay device including a capacitor that will delay such opening of the circuit for perhaps 30 seconds.

Provision is made for manually closing the valve from the outlet header of the pump to the surge valve and a push button switch, in series with the pressure switch may open the circuit as if the pressure switch had opened and thereby put the circuit through a test run, which will even trip the solenoid valve switch and open said valve and also test the panel light sequence.

The invention further provides a solid state flasher circuit and unique solid state battery condition indicator and battery charging circuit.

In the accompanying drawings showing one preferred embodiment of our invention with a solid state circuit capable of being contained, if desired, in a single enclosed metal box:

Figure 1:
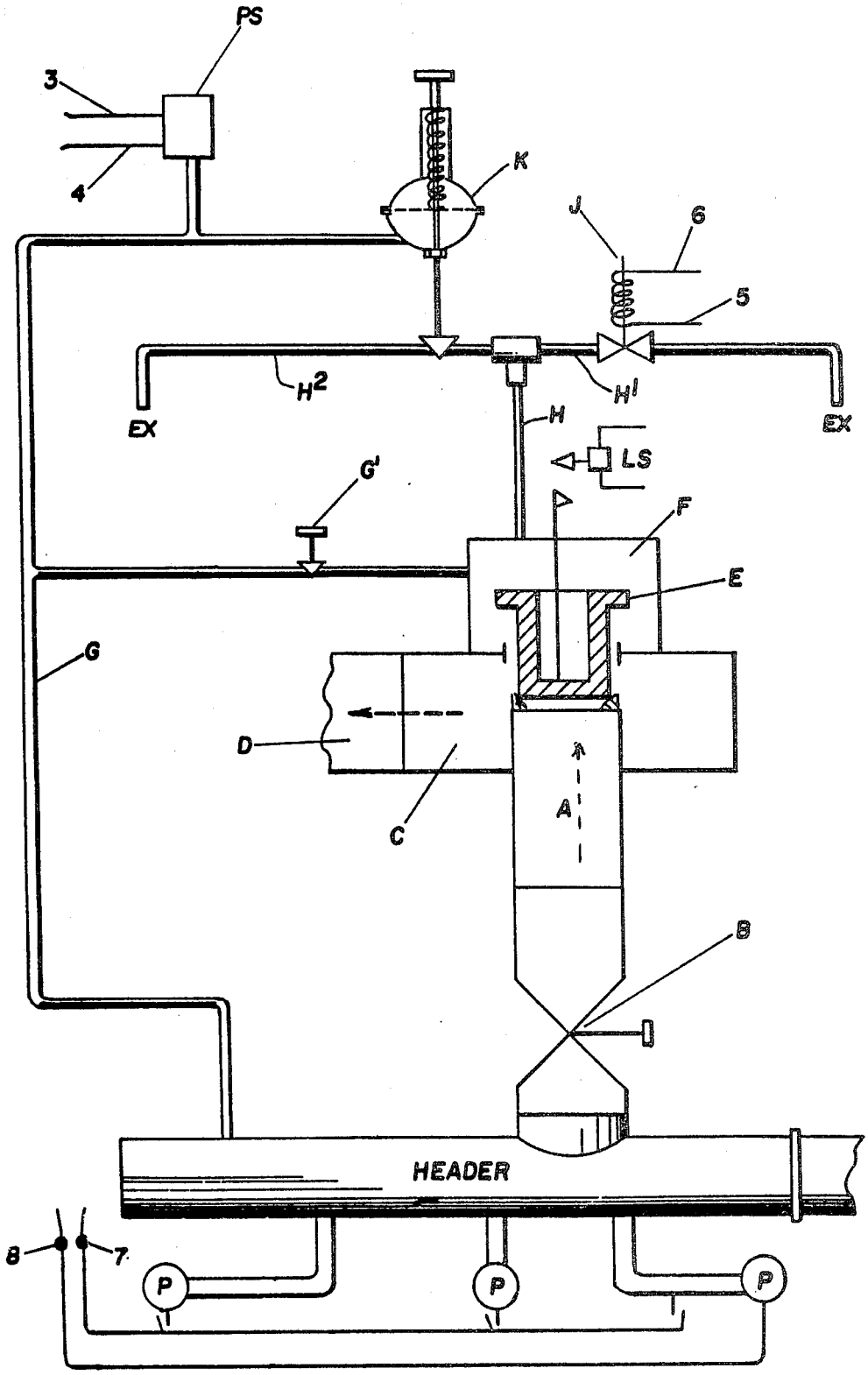
FIG. 1 is a more or less schematic view of pumping station surge valve and controls, with a multiple pump arrangement.

In the following description all reference characters preceded by the capital letter D refer to diodes which are conductive in the direction of the pointed electrode or arrow. All relay contacts are indicated by parallel lines, but where the contacts are closed when the circuit is ready for start-up, they are crossed by a diagonal line. To distinguish from capacitors, one of the two confronting lines of a capacitor is slightly curved. Time delay relay terminals for the number 2 time delay relay are designated TDR-2 followed by a circled number, as TDR-2 (3), where the circled number is a manufacturer's designation, whereas reference numerals having no circle are in the traditional designation where an uncircled reference character is an arbitrary designation. In some cases, to avoid complexity of circuit lines, the same part, as for example TDR-2 (14), will appear at different locations in the diagram. This is understood in solid state circuit diagrams.

Also in this application, reference to operations relates to abnormal conditions, such as mechanical breakdown or loss of power to the pumps, and not to the normal shutdown of a station where the shutdown is controlled in such gradual manner as to avoid surge producing conditions in the pipeline.

Referring first to FIG. 1, there is here schematically shown a surge valve installation for a pumping station having one or more electrically driven pumps P. In the diagram three pumps are indicated, all discharging liquid to be transported to a common header. Depending on the demands of the system, one or more pumps are normally operating to force liquid from a source of supply, not indicated, into the header to enter the pipe through which the liquid will ultimately be conveyed to a remote point of discharge elevated above the level of the pumping station.

The surge valve itself is a known and widely used device having an inlet A which, in this instance, is connected to the header through a manually operable shut-off valve B. The inlet opens into a chamber C with an outlet D. A valve element E is arranged to open or close the inlet A and the upper end of this valve element is located in a separate chamber F, the valve having a sliding fit in the body of the valve. The upper end of the valve element has a larger effective area than the lower end. Fluid from the header enters the chamber F through pipe G and needle valve G' and, as long as the pressure in the upper chamber is as great as the pressure in the inlet A, the differential area will keep the valve element seated and the valve will remain closed. If the pressure in chamber F drops below the inlet pressure under the valve element E, element E will be lifted from its closed position, opening the inlet to flow freely through the valve body to the outlet.

As long as one pump is operating, normal pressure will prevail in the header; but, if there be but one pump or any of a multiple number of pumps stops under abnormal circumstances as previously explained, there will be a drop in pressure in the header which will close a circuit through which the solenoid valve J will be energized to relieve the pressure in surge valve chamber F to open the surge valve, and if there is an overpressure in the header, the overpressure valve will be directly opened by the opening of overpressure valve K to relieve the pressure in chamber F.

The needle valve G' provides for the gradual restoration of pressure in chamber F when normal conditions return.

This invention is primarily concerned with the electrical equipment involved in operation of the solenoid valve J, the startup and operation of the pumps, the overriding of the operation of the solenoid when, after an abnormal or unscheduled shutdown of the pumps, operation is restored and indicating the conditions of the control circuits at all times, including delayed opening of the surge valve for a preset time, giving of advance warning that the circuit is prepared or armed to effect delayed opening and other features, as will hereinafter appear. The electrical equipment is especially designed to be incorporated in a single wall-mounted box as a single unit but may be divided into sections, some of which would be housed separately from others and interconnected. In either case, this equipment will be hereinafter referred to, both in the description and the claims, as the "box."

Figure 2:
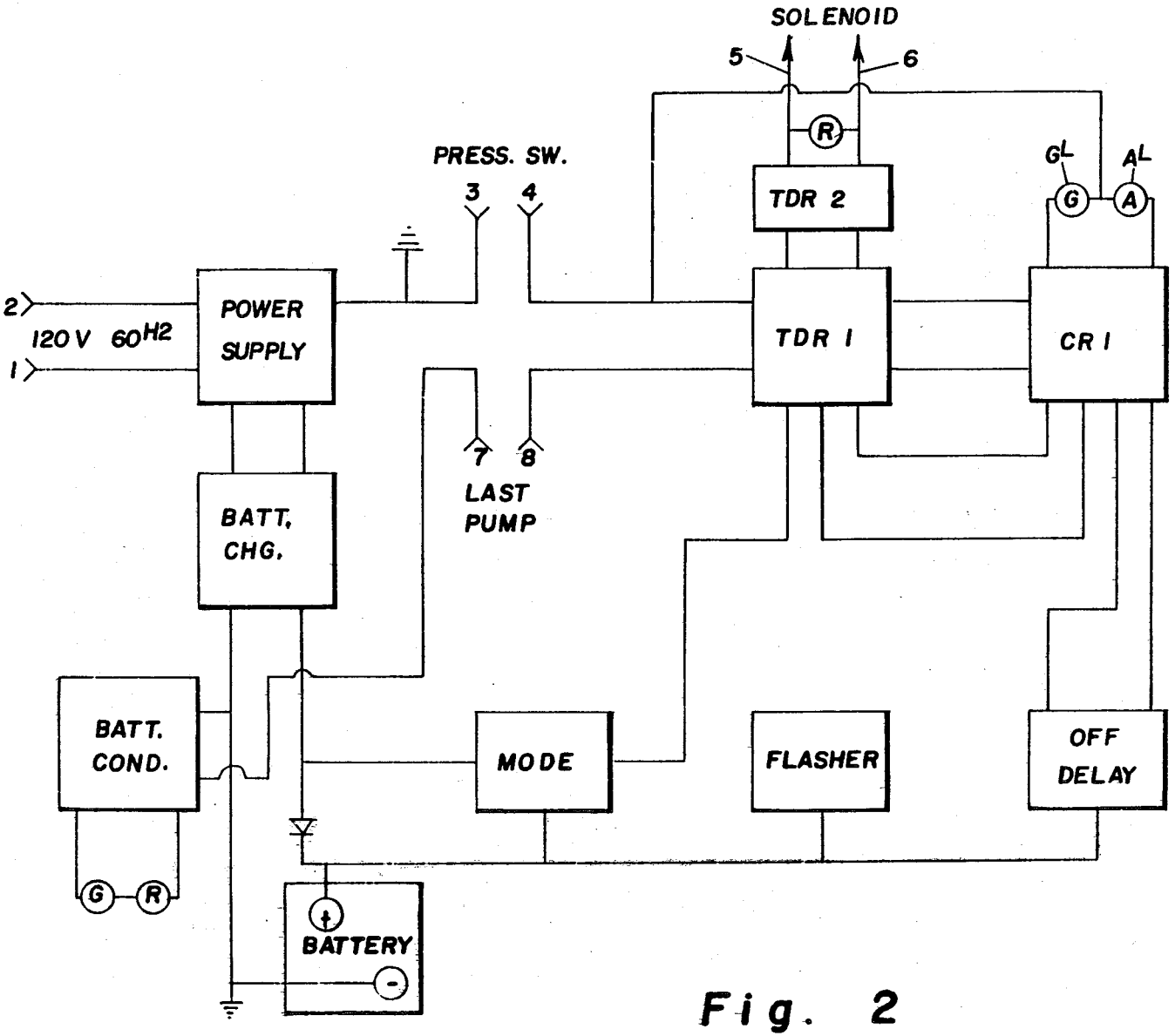
FIG. 2 is a block diagram of the various circuit components.

FIG. 2 is a block diagram of the box in which each block contains equipment, as indicated by the printed legend in the block. The box operates from a standard 120 volt, 60 cycle alternating current (AC) power source, which in this case is common to the power source for driving the pumps of the pumping station. The "Battery Charger" converts the AC to 24 to 34 volt direct (DC) current and supplies it to the storage battery, which is desirably a nickel cadmium battery that "floats" or is at all times connected across the battery charger output lines. The square marked "BATTERY COND" controls the selective operation of red and green indicator lights, as hereinafter described.

The following block marked "Mode" includes a manually operable switch which selects which of two procedures is the better suited for a particular station or under some certain condition. There follows a flasher unit that is energized under certain conditions only when a flashing green or amber light should be displayed by electric lamps GL or AL in the upper right corner of this figure. Next to the flasher there is an "Off Delay" relay above which is relay CR-1. To the left of CR-2 there is a first time delay relay TDR-1 and above this is TDR-2.

TDR-2 is the last of the several blocks in the diagram, but it will be observed that out of TDR-2 are two lines 5 and 6 which are the box terminals of lines 5 and 6 of the solenoid valve J of FIG. 1. Also to the left of TDR-1 are lines 3 and 4, these being the box terminals of lines 3 and 4 of the pressure switch PS of FIG. 1. There are two other terminals 7 and 8, these being the terminals of the power supply lines 7 and 8 of FIG. 1. While designated as power supply lines, they are actually lines to the starter switches of the pumps P; but since they open when a pump stops and are closed when a pump starts, they may be referred to as power indicating lines or auxiliary motor starter contact lines.

Figure 3:
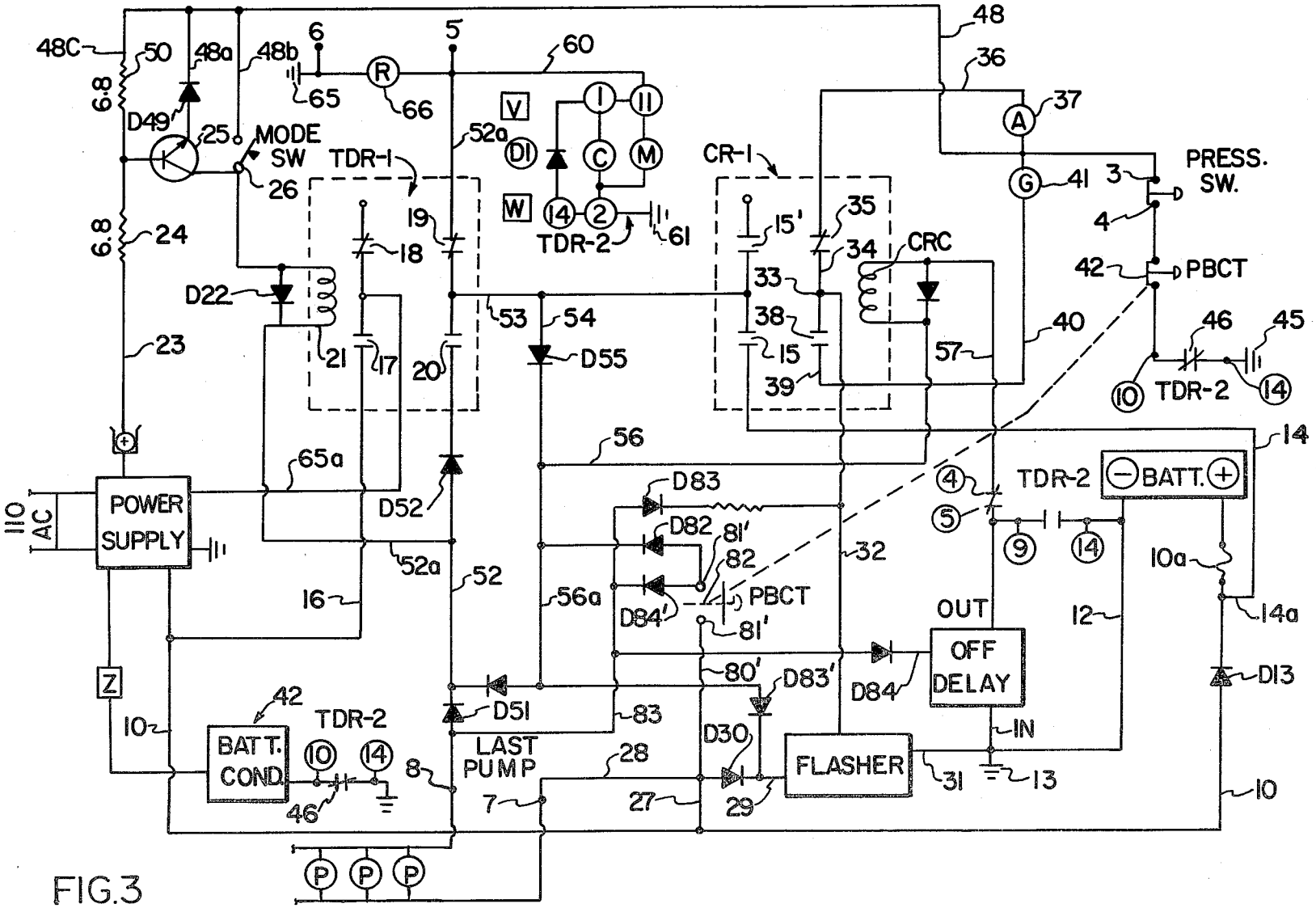
FIG. 3 is a schematic solid state circuit diagram with certain duplications of some elements to avoid confusing crosswiring.

Coming now to the explanation of the actual circuit, the first two blocks of FIG. 2 are combined in the square marked "Power Supply" in FIG. 3, the 120 volt AC input lines of which are designated 120 AC. The positive 24–34 volt DC output is designated by line 10 that extends from the positive terminal of the power supply downwardly, then across the diagram in FIG. 3 and then up to the positive terminal of the battery. A fuse is indicated in line 10 at 10*a* close to the battery. Line 10 also includes diode D-13, which allows the flow of direct current through line 10 toward the battery but not in the reverse direction, that is, from the battery back to the power supply. It may be here pointed out, since the circuit includes a multiplicity of diodes, the "point" of the arrow indicates the direction of current flow, but that current may not flow in the reverse direction, this being the common practice in the diagraming of solid state circuits. The negative terminal of the DC power supply is indicated by the conventional ground indication, and there is a return line from the negative pole of the battery and line 12 to ground, as indicated at 13.

A branch line 14 leads from line 10 at point 14 between diode D-13 and the battery and terminates at relay contact 15 of the control relay CR-1, the outline of this relay being indicated as a block in FIG. 2 and in broken lines in FIG. 3. Contact 15 is open at this point. Opposite or above contact 15 there is indicated another pair of contacts of a single pole, double throw relay which are never used. It should perhaps be explained that throughout the diagram the contacts indicated only by spaced parallel lines are pen, but they are closed when crossed by a diagonal line.

There is a branch line 16 leading from the positive side of the power source to contact 17 of time delay relay TDR-1 (also outlined generally as a rectangle in broken lines). It is a standard piece of equipment available as an off-the-shelf item and per se is not of our invention. It may be purchased, for example, from TKS Engineering Company of Minnetonka, Minn. In addition to contacts 17, this relay has contacts 18, 19 and 20. The timing circuit represented by 21 is the relay coil, and there is a one-way shunt circuit with diode D-22 across its terminals. There is a positive biasing voltage connection leading from the positive side of the power source through line 23 in which is resistor 24 to the base of a transistor 25 conventionally indicated with a base, a collector and an emitter.

As here diagramed, the emitter of the transmitter leads to mode switch 26 that connects to both one side of the coil 21 of the relay and the input side of diode D-22.

To explain further what may be termed the positive (+) side of the circuit, at all times when the power source is energized there is a branch connection 27 from line 10 between the battery and the power source with one lead 28 leading to terminal 7 of the pump circuit, as explained in FIG. 1. Another lead from 27 is connection 29 including diode D-30 leading to the flasher portion of the apparatus, which in FIG. 3 is represented by the block marked "FLASHER," an opposite terminal of which connects through line 31 to ground or negative at 13.

A line 32 leads from the flasher to connector 33 having a branch 34 leading through contacts 35, here indicated to be closed, to conductor 36 leading to one side of an amber light 37. Another pair of contacts leading from flasher connection 32 and the other branch of 34 is indicated at 39 in line 40 connected with one terminal of a green electric lamp 41.

Another element at all times included in the circuit is the battery condition indicator unit 42 connected at one side to connection Z and the other side to ground through TDR contacts (10) - (14) and by which red and green light emitting diodes (LED), generally designed for mounting on the door of a box, are energized, these being separate, of course, from pilot lamps 37 and 41 and also the red lamp hereinafter referred to, which are also, but not necessarily, mounted on the door of a box.

Further considering FIG. 3, the principal negative side of the circuit, starting with ground 45 at the right of the diagram, this part of the circuit comprises TDR-2 closed contact 46 across terminals or pins (14) and (10) across normally closed push-button circuit testing switch 47, across pressure switch contacts 3 and 4, here shown in closed position, to line 48 which a branch connection to the other terminal of amber light 37 and another to the second terminal of green light 41. Line 48 then extends to branch 48*a* which includes diode D-49 connected with the emitter of transistor 25. Another branch of 48 leads through connection 48*b* to the open terminal of mode switch 26. Line 48 also extends through line 48*c* including resistor 50 that balances similar resistor 24, both circuits thus leading to the base of transistor 25.

At this point, consideration may be given to the operation of the circuit. For the box to become armed and initiate the timing sequence, 120 volts AC must be supplied to the input lines of the power supply, and this should be derived from a power source common to that which drives the pumps, or in some cases just one pump, at the pumping station. There should be sufficient pressure in the manifold by reason of the back pressure of liquid still remaining in the pipeline after closing of the surge valve to close contacts 3 and 4 of the pressure switch PS and the circuit should be closed across the terminals 7 and 8 by the auxiliary motor starting contacts when the pumps are started.

If there is no AC voltage applied to the power input lines of the power supply, there will be no pilot lights operating. If there is 120 volt AC current applied to the power supply input with no closure of the pressure switch, only the battery condition light will light.

If there is 120 volt AC to the power intake terminals and there is a closure of the pressure switch contacts 3 and 4 by reason of the closing of this switch due to the pressure head of undrained liquid in the pipe line, most of which is not lost when the surge valve is temporarily open, with no pump running and therefore no closure of the circuit across terminals 7-8, the amber light A will flash intermittently in addition to the battery condition light being on.

If a pump now starts, closing circuit across terminals 7 and 8, the flashing amber light will change to a steady amber light. This happens because when a circuit is closed from 7 to contact 8, a circuit is then closed from 8 through line 83, diode D-83 and line 32, thereby shunting out the flasher. Also at this time DC current is then supplied to the timing circuit 21 of TDR-1 which provides a time delay that precludes the possibility of surge valve actuation due to minor pressure variations during pump start-up, this circuit being from 8 through diode D-51, line 52, line 52*a*, timing circuit 21, to switch 26 which, as here shown, is through transistor 25, diode D-49, connection 48*a* to ground at 45. When TDR-1 has timed out, the TDR-1 and coil 21 are energized, the relay will operate to open contacts 19 and close contacts 20, to then establish a circuit through D-52, line 53, branch 54, D-55 and line 56 to one side of coil CRC of control relay CR-1, the other terminal of which is connected to ground line 57, TDR-2 normally closed contacts (4) and (5) through the off-delay to ground. Energizing relay CR-1 operates to open its contacts 35 to extinguish the amber light and apply current across contacts 39 to apply steady current to green light G.

When steady DC flow has been established in this way through line 56 to the coil of CR-1 of relay contacts 39, they will remain in this condition unless or until the circuit is de-energized and it must then be again re-established through the operation of TDR-1, as will only occur with the next opening of the pressure switch PS. The display of the solid green light indicates that the circuit is armed and ready to function.

As long as the pumping station is functioning normally the green lamp will stay lighted. With the mode switch 26 in the position shown and the coil 21 of TDR-1 remaining energized, no change will occur, assuming of course that the battery and charger remain in good condition. However, should there be a power failure to the pumps or should the pressure switch open, or both take place, and the coil 21 becomes de-energized, the protective sequences will be initiated.

Assuming first that switch 26 is in the position shown in FIG. 3, the circuit for coil 21 is through the transistor 25 to ground (line 48). If there is a power failure to the pumps, there will also be a power failure to the power supply unit, since the pumps and power supply derive their current from the common source at the pumping station. This then will de-energize line 23 from the power source to the base of transistor 25 because line 23 is not in the battery circuit. Transistor 25 thereupon becomes instantly nonconductive and there is, therefore, no conducting ground connection through the relay coil to line 48 and TDR-1 instantly returns to its normal condition, opening contacts 20 and closing contacts 19. CR-1 relay is not affected by the power failure, and current will then flow from line 14 on the plus pole of the battery across closed contact 15, line 53, now closed TDR-1 contacts 19 to the upper end 52*a* of line 52, solenoid valve terminal 5, through the solenoid valve to ground at terminal 65. Also there is a circuit across terminals 5 and 6 through red light 66 to light said light. As the same time branch line 60 is connected through TDR-2 contact 11 and through this relay to ground at 61.

The same thing happens if, instead of a power failure, the pressure switch opens, TDR relay 1 loses its ground through the pressure switch to ground connection 45.

Operation of TDR-2 opens contacts 4–5 at the end of its timing cycle to de-energize the coil of CRC of control relay CR-1, returning this relay to its original condition, thereby also extinguishing the red light and closing the solenoid valve.

Both timers, as is usual with such time delay relays, have a dial (not shown) to adjust the length of the delay and reset themselves after they operate for the next operation at the same dial setting until the dial setting is changed. Typically, the time delay relay of TDR-1 may be adjusted to range from a period of a few seconds to 300 seconds, or more, and the purpose of this delay, as previously indicated, is to avoid surge valve opening with minor surges and pulsations that occur during pump start-up.

Time delay relay TDR-2 is set to provide a shorter and more accurately timed operating cycle. It may be explained that with an abnormal shutdown of the pumps such as will give rise to a downsurge of water pressure, the shock wave that begins with a drop in pressure in the pump header travels, as heretofore explained, to the discharge terminal of the pipeline and then returns to the pumping station as a pressure surge or backflow of water and, in a long pipeline, this interval may be any time from several seconds to minutes. Even the sound of the onrushing surge of water will be clearly audible at the pumping station before its actual arrival. It is only necessary to open the surge valve for a short period of time preceding the pressure surge of water until after the force of the pressure surge has been dissipated, and TDR-2 therefore is set to time the opening and closing of the solenoid valve to meet this schedule, which will differ with different stations, elevation of the discharge above the pumping station, and length of the pipeline.

Reference has heretofore been made to mode switch 26 in the upper left corner area of FIG. 3. It is a manually operated two-position switch, and these positions are usually referred to as Mode A and Mode B; but, to avoid possible confusion with A and B of FIG. 1, they will be here referred to as MA and MB. In the diagram in FIG. 3, the switch 26 is in the MB position. If the switch 26 is moved to bypass the circuit through transistor 25 and make direct connection with wire 48*b* to line 48 where coil 21 will lose power only after the opening of the pressure switch to break the battery circuit to ground. Hence, in this setting, a power failure does not directly result in opening the surge valve.

If the mode switch 26 is in the MA mode and power failure to the pumps occurs, the circuit goes into a standby armed condition for about 30 seconds during which the green light 41 flashes, the only circuit at this time being from the battery into the flasher through switch 15, D-55, D-83', through line 32, connector 34 and contacts 39 to green lamp 41. A 30-second armed condition after power failure is achieved through the off-delay unit, the negative charge of which provides a continuing negative polarity to the magnet coil of CR-1. If at this time a pressure surge is imminent, the TDR-2 contacts (9) and (14) will close and assure completion of a full cycle even if the off-delay time has expired.

Should no pressure surge occur during the standby armed state, the off delay will cease to maintain a negative voltage on the negative pole (upper end in the diagram) of the relay coil at the end of its delay period. This removes positive current flow through the timing circuit, whereby it then deactivates the circuit completely.

Should, however, the circuit be armed in either the MA or MB modes and a normal programmed shutdown takes place, opening the circuit across auxiliary motor starter terminals 7–8, the off delay circuit loses positive DC control voltage and begins its delay period of approximately 30-second to a nonconducting state for removing the negative polarity (sometimes conveniently referred to as "negative DC") to the negative terminal of the relay coil of CR-1. If a downsurge occurs during this period, the circuit will respond with the instant opening of the solenoid valve J, as previously described.

However, if no downsurge occurs during this period, as will hereinafter more fully appear, but with the exception that since the 120 volt AC current is not interrupted, the amber light will resume flashing, indicating a standby unarmed circuit condition.

In FIG. 3 it will be observed that there is a line 65a which comprises a conductor between the power supply and TDR-1. When contacts 17 close, this conductor supplies current directly to provide a shunt around conductor 26 after contacts 19 and 20 are closed to take care of the increased load at this time without, however, charging the circuit with the battery.

The push button test switch in FIG. 3 is shown in series with the pressure switch and switch 46, for ease of following the overall circuit. However, the diagonal dot-and-dash line positions it near the lower center of the diagram. Testing of the circuit may be effected even though the pumps are not operating in a normal manner and the circuit is not armed.

For ease in following the test operation, the reference numerals will be marked with a prime (') for following the test. Positive DC is supplied from line 10 and branch line 80' to switch contacts 81' arranged to be closed by pressure on push button switch 82'. This will allow positive DC through diode D-82 to line 56a, to line 56 to one side of the coil CRC of control relay CR-1. From this point current will flow through said coil, line 57, and off-delay to ground at 13. At the same time, current will flow through D-84' and D-84 causing the off-delay to conduct. This will result in the opening of the surge valve during timing on TDR-2 through the closed contact 19 and of TDR-1 the operation of the solenoid valve as previously described. At this time, manually operable valve B (FIG. 1) will be opened only slightly to avoid spilling unnecessary amounts of water throuh the surge valve in this test.

THE POWER SUPPLY UNIT (FIG. 4)

Figure 4:
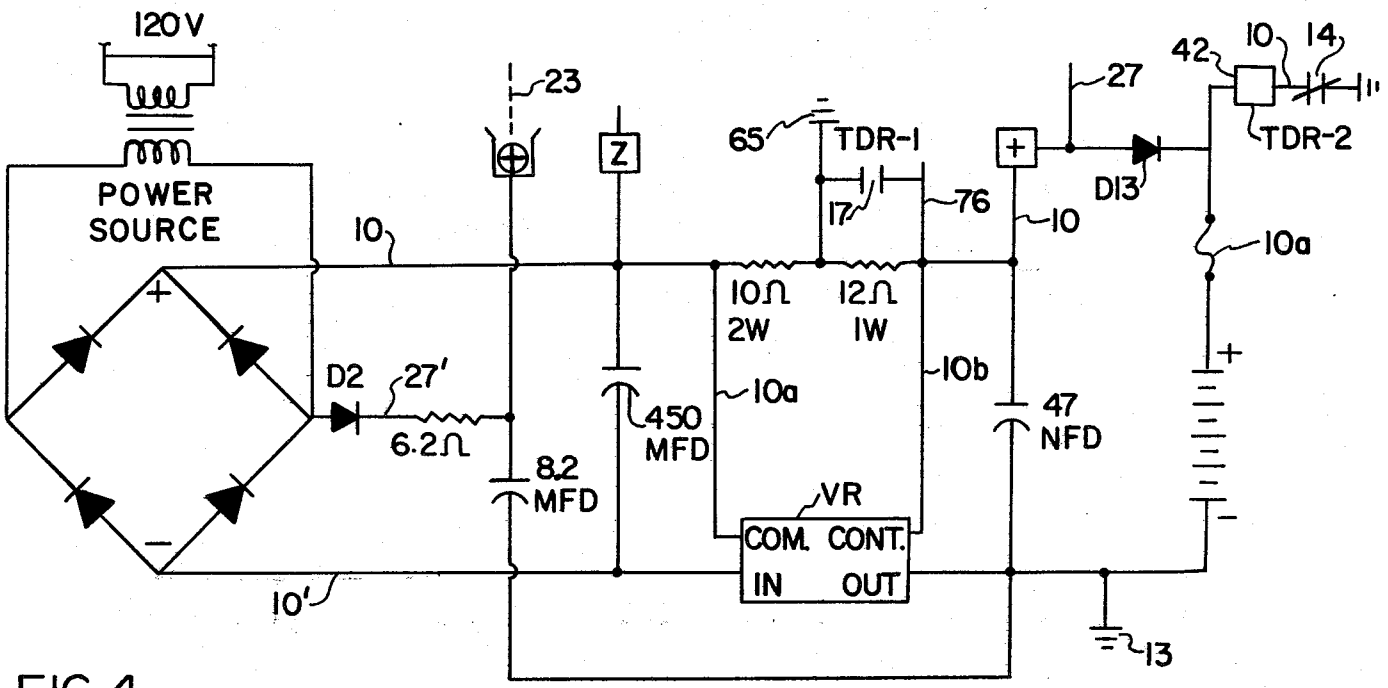
FIG. 4 is a schematic circuit diagram of the power supply circuit.

As previously stated, the batter is a nickel cadmium (NiCd) battery. FIG. 4 discloses one power supply for this battery, but the invention is not necessarily restricted to such a power supply. As indicated, the AC input connections across the primary of a step-down transformer, the secondary 100 of which is connected across the input terminals of a full wave rectifier indicated by the square with oppositely directed diodes leading in divergent directions to the positive (+) and negative (−) output terminals. Line 10 from the + side of the rectifier has two resistors indicated as 2W and 1W. TDR-1 contacts short out 1W when the current requirements of TDR-1 and CR-1 are added to the output to keep the charging current to the NiCd battery unchanged. Biasing voltage for the transistor 25 is provided by the positive half wave positive off-take 23, which is not in the battery circuit.

It has been previously explained that the power supply for the battery, that is, the primary transformer of PS-1 (FIG. 4) is derived from the same power source that supplies the pump so that, when the power to the pump fails, the transformer will also fail to operate and the battery will then take over the operation of the pump protective system in the event of an unscheduled loss of power to the pump.

For reasons of efficiency and general reliability, and under proper conditions, a nickel cadmium storage battery is preferably used, but this assumes that most of the time they will be kept at full charge until called upon in case of emergency and provided they are reasonably protected against wide temperature fluctuations.

This power supply, with a battery condition indicator, is conventionally shown in FIG. 3. The unit is labeled "Power Supply" in FIG. 3 and is schematically diagrammed in FIG. 4, where it is similarly marked. In FIG. 3 the power supply, indicated as the square box, is connected into the two power lines marked "110(V)AC." As stated, these power lines derive current from the same source that drives the pump or pumps. A ground or negative terminal is schematically indicated in FIG. 3 at the right of the box.

The main positive DC outlet from the rectifier is designated 10 (FIGS. 2 and 4) and there is a branch line (see FIG. 4) connected with 10 (inside the casing in FIG. 3) marked [Z] which leads to a battery condition indicator 42 (FIG. 3). The negative or ground circuit from 42 (indicated in the lower left corner of FIG. 3) is to terminal 10 of TDR-2 across normally closed contacts 46 to TDR-2 terminal 14 and ground.

As clearly shown in FIG. 4, the line 10 leads from the positive (+) terminal of the full-wave rectifier (schematically indicated by a square with a diode in each side of the square, with two opposed corners connected to the secondary terminals of the transformer, the other two diagonally opposite corners of the square rectifier being indicated by signs + and −). Line 10 leads from the + terminal of the rectifier and 10' from the negative terminal. Line 10 leads from the + terminal of the rectifier to the + terminal of the battery (see FIG. 4) which is preferably a multi-cell nickel cadmium battery. Between its ends, line 10 has a branch connection [2] into which the battery condition indicator 42 connects. There is a capacitor marked "450" across the lines 10 and 10'.

In line 10 as shown in FIG. 4 between the rectifier and diode D13, there are two resistors 1W and 2W in series. They may be equal, but generally 1W will be greater than 2W, the former being designated "12" ohms and 2W as "10" ohms. There is a shunt circuit around resistor 1W comprising line 65, and an "on or off" load indicated 17 as an open switch but which in this case, as indicated in the drawing, is time delay relay TDR-1. When TDR-1 is energized, the resistor 1W is shunted out.

Line 10′ leads through a voltage regulator, represented by the rectangle VR to the negative pole of the battery. There is a second shunt circuit comprising line 10*a* from line 10 between the rectifier and both resistors 2W and 1W to the positive input end of the voltage regulator VR and output connection 10*b* from the voltage regulator to line 10′ between the resistors 2W and 1W and diode D13.

This arrangement results in the battery charging circuit being in effect in parallel instead of in series with the load circuit comprising TDR-1 so that when the relay TDR-1 is in effect drawing current from the rectifier, additional current will flow to the battery through the voltage regulator circuit, protecting the battery against any effective drain in the event, as in this instance, of sustained energization of the relay.

Figures 5, 6:
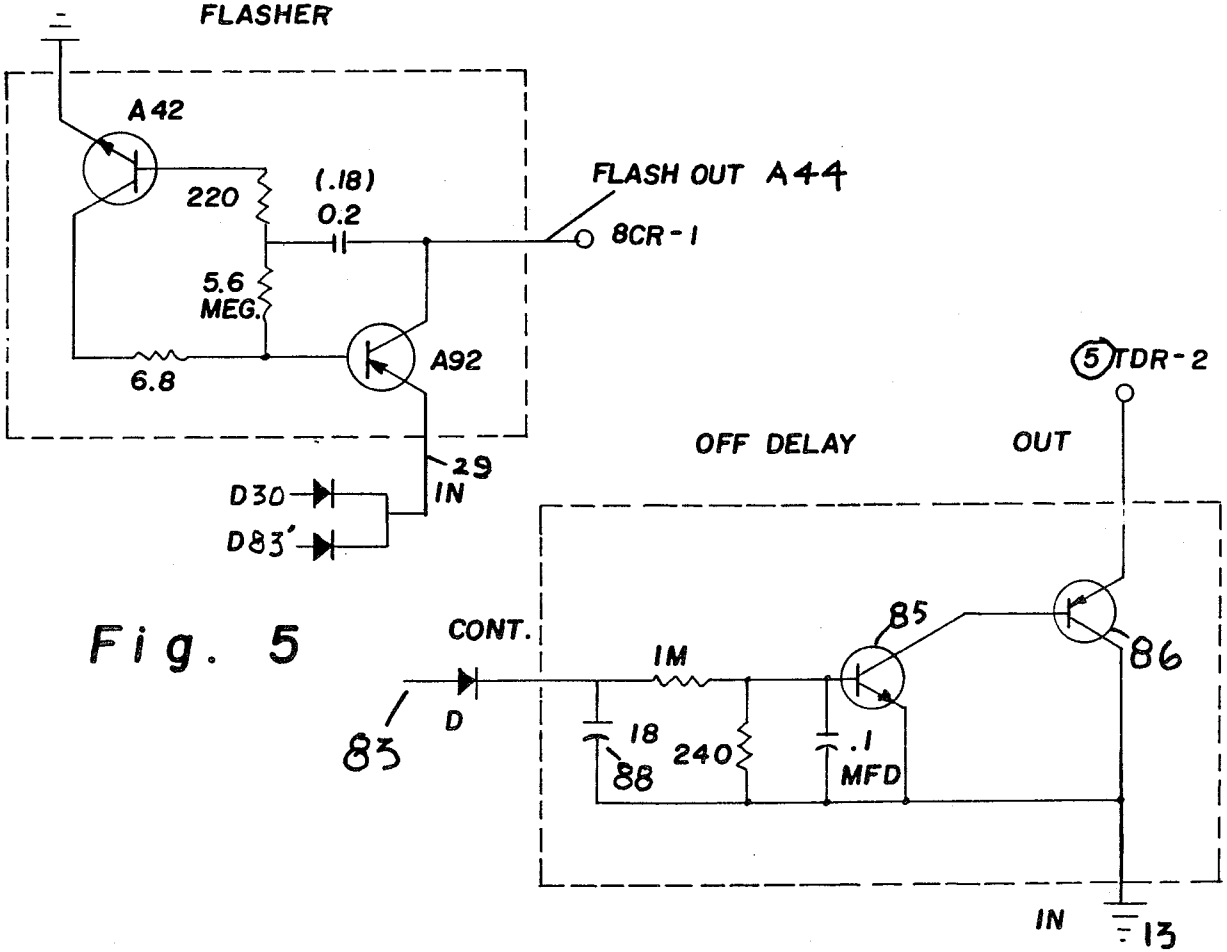
FIG. 5 is a schematic view of the flasher circuit.
FIG. 6 is a schematic view of the "Off-Delay"

The Flasher (FIG. 5)

Conventional flasher circuits of various types may be used, such as magnetic on-off switches, thermal on-off switches but, for compactness, lightness and absence of heating elements, but the simple circuit shown in FIG. 5 has proved most satisfactory.

When positive DC current is applied to line 29′ through either of the diodes D-30 or D-83′ (see FIG. 3), the then discharged 0.2 capacitor A-43 in the flash-out circuit A-44 applies bias through resistor 220 to the base of transistor A-42 to thereby apply voltage through resistor 6.8 to the base of transistor A-92. Current then flows from the collector of A-92 to A-44 leading to contact 35 or 39 of CR-1 to flash either the amber or green light as the case may be. When 0.2 capacity again becomes completely charged, causing transistor A-42 to turn off, in turn causing transistor A-92 to turn off, extinguising the lamp. The capacitor 0.2 discharges through the filament of the lamp and the 220 kΩ resistor to the base of A-42. This results in driving transistor A-42 hard to the cut-off condition, keeping the lamp extinguished. When capacitor 0.2 completely discharges, the cycle repeats with a frequency determined by the circuit components. We prefer about 100 cycles per minute.

The Off Delay (FIG. 6)

Referring to FIG. 6, positive current from line 83 (FIG. 3) is connected through diode D-84 to the 1 megohm resistor and the base of transistor 85 to conduct current to a negative current path which is established through transistor 86 from ground 13 (FIG. 3) to contact 5 of TDR-2. When positive current is lost across terminals 8 and 7 due to a power failure or the stopping of the last pump, the 18 mfd capacitor 88 supplies an "on" bias to keep transistors 85 and 86 conducting for about 30 seconds after which the negative side of the circuit from 5 of TDR-2 to 13 ceases to conduct.

Figure 7:
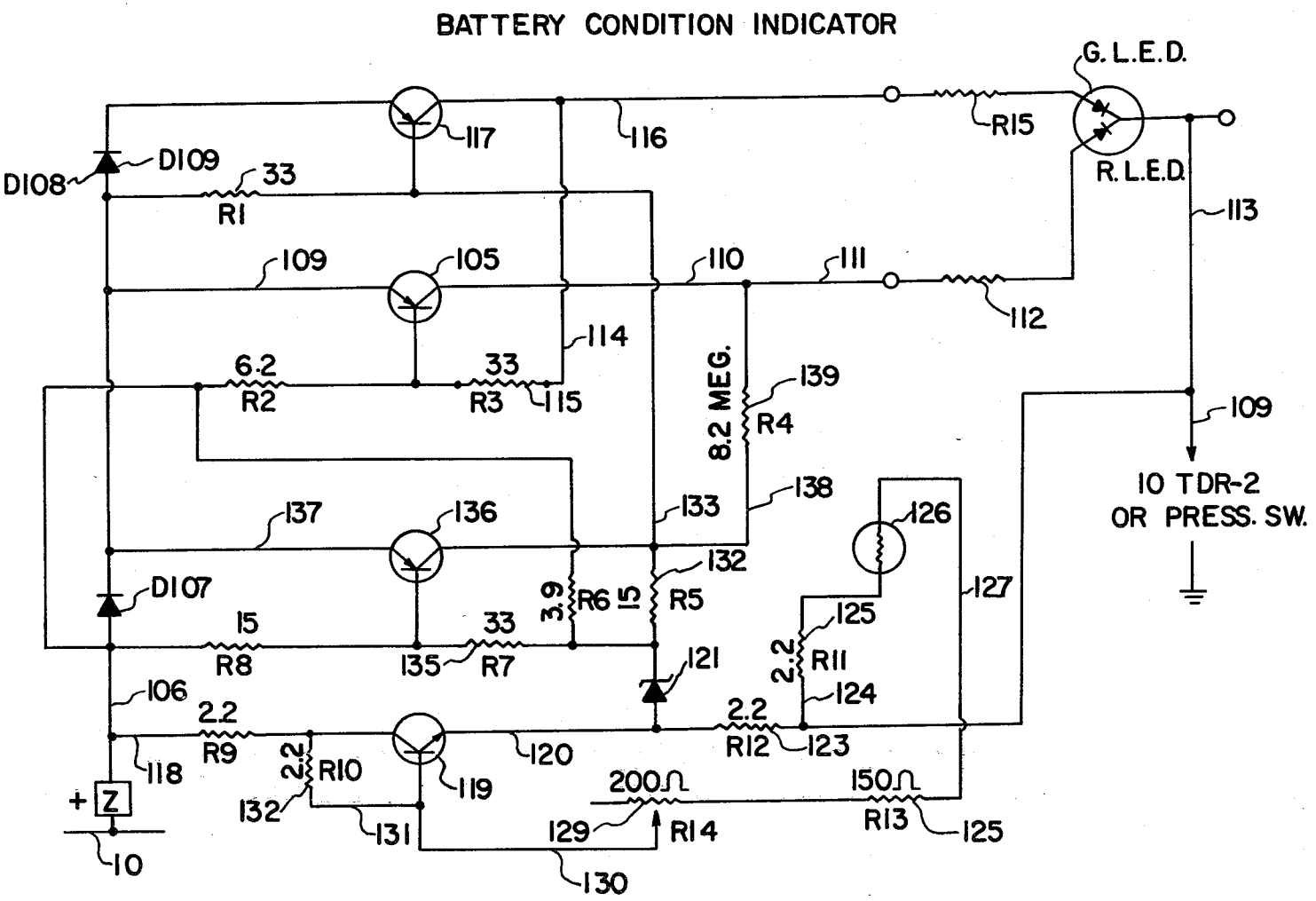
FIG. 7 is a schematic view of the "Battery Condition Indicator."

Battery Condition Indicator (FIG. 7)

In FIGS. 3 and 4 of the drawings, Z designates the terminal of a conductor leading from line 10 to which the unit in the drawing (FIG. 3) marked "BATT. COND.," meaning Battery Condition Indicator, has its positive terminal connected. The negative terminal of the indicator comprises a line leading from the unit to contact (10) of the time delay relay TDR-2. As indicated in FIG. 3, this contact is normally closed with contact (14) of the same relay which is grounded. Therefore, at all times TDR contacts (10) and (14) are closed the battery condition indicator is energized. The indication is shown in red or green, preferably on the door of the box, if there is a single box as previously explained, or at some associated area where it is always visible. Preferably, a trichromatic light emitting diode (LED) (FIG. 7) supplies the indication, i.e., red or green as conditions require. The circuit is designed so that the red indicator appears whenever some specific circumstance prevails, that is, circumstances indicating that the battery voltage during constant current charging is set within certain prescribed limits. These limits vary inversely with the battery temperature. If with charging of the battery continued these limits are met, the red light is extinguished and the green LED signal light is energized. This green LED is of course unrelated to green light 41 in FIG. 3.

Red LED is energized through transistor 105 from connection Z (FIG. 3) through conductor 106 in which are diodes 107 and 108, the emitter of 105 connecting to positive line 106 through branch line 109. The collector of transistor 105 is connected through lines 110, 111 which includes resistor 112 and terminates at the red LED. The circuit from red LED to ground or negative circuit is through conductor 113 and through TDR-2 and its contacts (10) and (14) to ground.

Red LED is biased at this time through connection 114, in which is resistor 115 which connects with line 116 connecting the collector of transistor 117. The flip-flop is, of course, in either direction, green to red or red to green. With this arrangement the red LED will never light when the green LED is lighted because, when transistor 117 is conducting, line 116 changes from negative to positive, reversing the polarity of the base of transistor 105.

There is a circuit comprising line 118, transistor 119, negative line 120 from the transistor to zener diode 121 and also through branch line 122 with resistance 123 to the negative line 109. There is thermistor circuit shunted around transistor 119 comprising line 124, resistor 125, thermistor 126, positioned physically between the cells of the battery where it responds to battery temperature, and line 127 in which is a 150 ohm resistor 128 and a variable 200 ohm resistor 129. A line 130 from the latter biases the base of resistor 119 and there is a connection 131 with resistor 132 to line 118. It will be noted that transistor 119 is, in effect, reversed with respect to the other three transistors positioned one above the other in the diagram in FIG. 7. For ease of recognition, these three transistors together with transistor 119 are referred to in descending order as 1, 2, 3 and 4, a designation hereafter referred to in the claims. This reversal is to maintain a negative potential from ground to the emitter of 119 to meet the reverse conductivity of a zener diode.

When the voltage of the emitter of transistor 119 reaches a value such that the zener diode will conduct, resistor 132 puts sufficient negative bias on the base of transistor 117 through line 133 so that it conducts, lighting the green LED and extinguishing the red, since the collector of 117 which previously was negative now becomes positive, removing the negative bias from transistor 105.

The green light indicates the battery voltage is normal for the temperature of the battery at the constant prevailing charge rate. If, however, the negative bias on the base of the third transistor increases sufficiently to bias the base of the third transistor 136 through resistance 135 for an overriding voltage to be applied to line 133 above resistor R5, the bias on the base of the transistor 117 becomes positive and ceases to conduct whereby line 116 will again apply a negative bias to the second transistor to again light the red LED. Thus there is a flip-flop from red on undervoltage, green in the proper charging range and back to red on overvoltage, the green range being a relatively narrow band which indicates the nickel cadmium battery condition as good for any given temperature. The thermistor is in physical proximity to the battery to respond to its temperature but electrically separate. It responds inversely to a temperature increase so that, as the temperature of the battery rises, the base of transistor 119 becomes increasingly positive through connection 118 and 131, increasing the negative flow in line 120.

Red on the undervoltage side of green indicates a shorted cell or discharged battery and, on the overvoltage, indicates an open cell or a blown fuse. Green spreads over a slight variation from one side or the other of normal indicating that the battery and battery circuit are in operating condition and properly charged.

In the foregoing battery condition indicator circuit a trichromatic LED is preferred to separate red and green light emitting diodes, since in a border zone, when a change from one to the other is about to take place, both diodes may be operating and their combined operation will produce a yellow color that will replace the red or green to attract attention to a changing situation.

Modification

Figure 8:
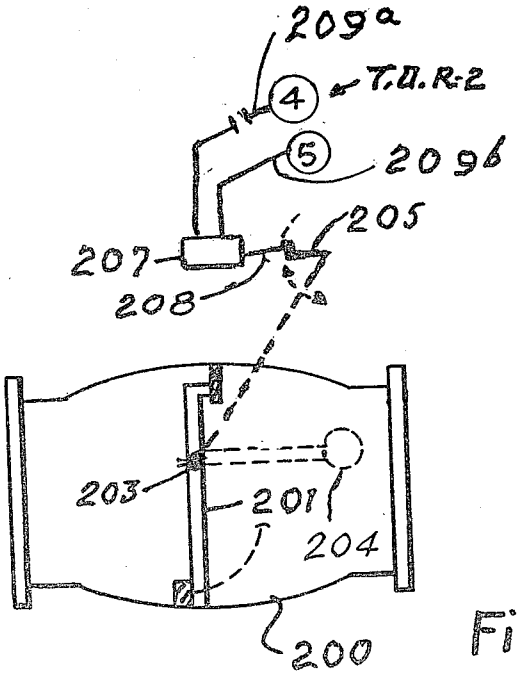
FIG. 8 is a fragmentary detail view for use in a pumping station with a check valve in the pump outlet and means to prevent closing of the surge valve before the check valve has closed.

FIG. 8 is a schematic illustration of a modification wherein the pump discharge sysem includes a check valve that opens away from the pump into the pipeline and which may sometimes be open after the surge valve has closed. To prevent closing of the surge valve before this check valve has closed, the arrangement disclosed in this figure provides a simple solution.

In this modification, 200 is the check valve having a gate 201 that pivots about a shaft 203, at least one end of which extends outside the casing. The view is an exploded view where the dotted line indicates the axis of this shaft and on the projecting end of the shaft there is indicated an extension or cam 205 which, when the check valve is in the closed position holds open a microswitch indicated by a casing 207, and an arm 208 that is raised slightly to the open position when the valve gate is closed.

When the valve gate is even partially open, the extension 205 swings down, allowing the microswitch arm 208 to spring down and close the switch. Two leads 209*a* and 209*b* from the switch connect across terminals (4) and (5) of TDR-2 (FIG. 3). If TDR-2 is at that time about to open the circuit to CRC of CR-1 to close the surge valve by opening the circuit to the solenoid valve, the microswitch then being closed provides a shunt circuit across contacts (4) and (5) so that CR-1 does not "know" that the circuit between (4) and (5) had otherwise been opened, and therefore keeps operating to hold the solenoid valve circuit energized and keep the surge valve from closing. When the gate swings to closed position, the microswitch opens in the manner above described and the bridging of the circuit across contacts (4) and (5) is removed and the surge valve will close.

Figure 9:
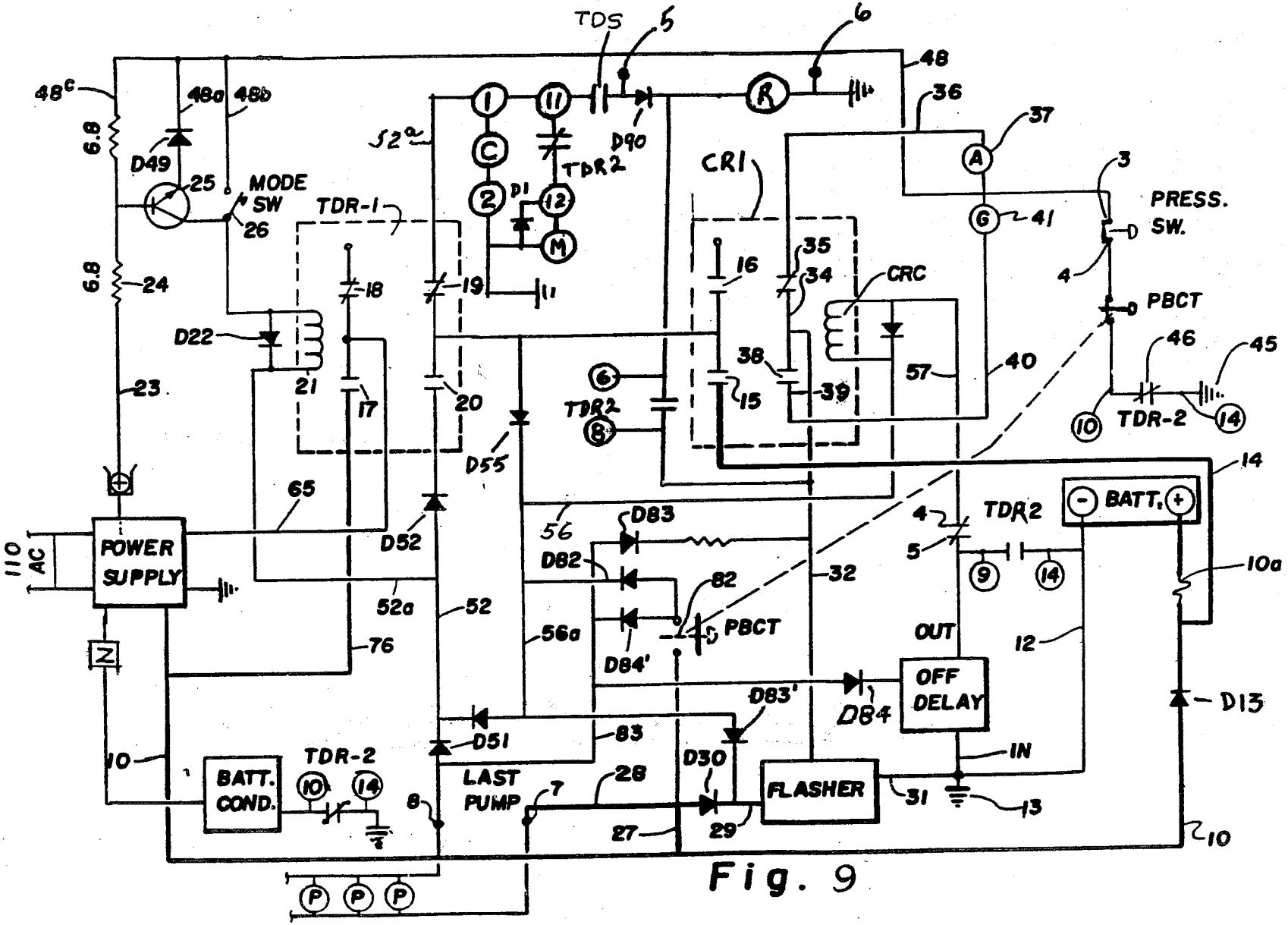
FIG. 9 is a circuit diagram similar to FIG. 3 but with one timer having a circuit arranged for long pipelines between the pump and the discharge terminal.

The circuit shown in FIG. 9 is a modification of FIG. 3, but all elements common to the two circuits have like reference numerals. This circuit is especially designed for use in pumping stations where the surge valve and pipe discharge terminal are a long distance apart, so that there is a relatively long time lapse between the downsurge or pressure drop at the pumping station when an abnormal or unprogrammed pump stoppage occurs, and the time the resulting pressure surge arrives from the pipe terminal to the pumping station may be a period of many seconds to as much as two minutes or more.

In FIG. 3, TDR-2 opens the solenoid valve to open the surge valve almost instantly for a period of time selected on TDR-2, nominally from 10 seconds to 30 seconds after the pressure drop or downsurge at the pumping station and then initiates the gradual closing of the surge valve. However, with long pipelines, the opening of the surge valve should not occur until a few seconds before the arrival of the pressure wave or surge at the pumping station, so that excessive amounts of water or other liquid would not be drained from the line during that period.

In FIG. 9 there is shown a modified TDR-2 type relay with an added set of contacts which will close sometime following the initiation of the operating time of the relay and the expiration of the period over which it is timed to run, and the circuit in FIG. 9 with the compound series of two switches that may be used to accomplish our purpose, that is, start the running of the time relay in its scheduled sequence but delay opening the solenoid valve to start the opening of the surge valve at some definite time period thereafter.

In FIG. 9 the TDR-2 relay is here shown with contact (12) in series with (11) through a normally closed switch as diagrammed. The switch contacts, shown at TDS (these being the initials for time delay switch) are in series with 5, leading to the solenoid valve, as does the numeral 5 in FIGS. 1 and 3. The numeral 6 is the return line from the solenoid switch to ground, as in FIG. 3. There is a diode D-90 between 5 and 6 and in series between this diode and 6 there is a red light R corresponding to 66 in FIG. 3. However, there is here included the flasher as in FIG. 3 through line 32A, TDR-2 contacts (6) and (8) (which are normally provided on these relays but not used, and therefore not shown in FIG. 3), and line 32 so that when TDR-2 starts timing and before TDS contacts close to 5, the light will flash red, indicating the delay time before the surge valve opens by closing of TDS. During this flashing period, diode D-90 blocks the positive flashing to the solenoid valve terminal 5. When TDS contacts close, energizing solenoid valve diode D-90 conducts positive to light the red light continuously during the time the valve is open.

Figure 10:
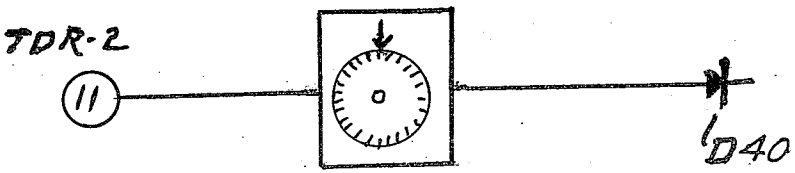
FIG. 10 is a schematic view of a compound switch arrangement for use with FIG. 10.

In FIG. 10, a manually adjustable electrically operated timer comprises switch TDS. TDR-2 determines the overall running time lapse from its beginning to the time it reaches its "off" condition. The timer X will be set to close the circuit between TDR-2 and the off time of TDR-2. Therefore, even though TDR-2 is running for the overall time from it start with closing of TDR-1 contacts 19, the circuit to the solenoid valve will be closed only when timer X starts running until TDR-2 runs out.

Conclusion

As previously pointed out, the herein described circuit is capable of operating in either of two modes, to be selected by the operator by manual operation of the mode switch according to the requirements of a particular installation. The MB mode provides surge valve actuation on each power failure or pressure switch actuation any time the circuit is armed and for a time period of 30 seconds after the last pump is shut down.

The MA mode provides for surge valve actuation with an opening of the pressure switch only any time the circuit is armed and for a time period up to 30 seconds after the last pump is shut down. It is desirable where a power failure may be of a character where no significant downsurge will follow. For example, if there were a power failure to a single small pump in a large pumping station, the pressure switch might not respond because the effect would be too small to produce a surge, even if at the time of the power failure, the demand at the output would require no other pumps to be operating and this remaining small pump would be the last pump to operate.

Briefly summarizing, the invention provides a compact solid state circuit for use in a pumping station as described, wherein an operator at a glance can be aware of the condition of the surge control system and is given advance warning of conditions which may be expected to produce a pressure surge of potentially destructive character and open the surge valve sufficiently in advance of the surge, but not so prematurely as to spill excessive quantities of water before the actual surge takes place. It provides for re-arming itself after the surge has passed and normal conditions are restored, i.e., AC power, normal pressure, pump started, and the invention informs the operator of when the circuit is in condition to safely reactivate the pumps but prevents operation of the surge valve in a preset time period. Two manually adjustable time delay relays and a single circuit relay are under the control of one or the other time delay relays. Mode selection provides for the adaptation of a single unit or box to different pumping station requirements most likely to be encountered. Overpressure conditions are taken care of in the usual manner without intervention or operation of the present circuit or box.

We claim:

1. A battery condition indicator for use in a circuit comprising a DC power supply connected across the terminals of a nickel cadmium battery, comprising:

(a) a first main branch leading to the positive side of the power supply;

(b) a second main branch leading to the negative side;

(c) four transistor circuits connected in parallel with said positive main branch and each including a transistor, the four circuits and transistors being herein designated 1 to 4, the fourth transistor in the series 1 to 4 having its emitter connected through a circuit with the negative main branch of the DC current source;

(d) a connection from the negative emitter circuit of the fourth transistor to the base of the first emitter, said connection including a resistor;

(e) the second transistor having its base connected with the collector-to-green LED circuit of the first transistor;

(f) a zener diode having a connection from the negative emitter circuit of the fourth diode through said zener diode with the base of the first transistor with a resistor between the zener diode and the base of said first transistor;

(g) a shunt circuit around said last-named resistor wherein the base of the third transistor is connected through a resistor to the connection leading from the zener diode to the base of the first transistor at a point between the zener diode and the resistor in said connection, the collector circuit of the third transistor being also connected to the connection between the zener diode and the base of the first transistor but joining said connection between the said resistor in said connection; and (h) the said four parallel transistor circuits as herein defined being thereby so arranged that a normal charging current path will put a negative bias on the base of the first transistor to light the green LED, thereby extinguishing the red, but lighting the red by an absence of adequate negative voltage in the base of the first transistor, and the lighting of the green by the application of adequate negative voltage through the zener diode circuit to bias the first transistor, the green LED being extinguished when the charging voltage is above normal by the positive voltage from the collector of the third transistor offsetting the negative flow from the zener diode, but by reason of the resistor in the connection between the zener diode and the base of the first transmitter enabling the zener diode to continue to supply a negative bias to the base of the third diode.

2. The battery condition indicator defined in claim 1 in which a thermistor inversely responsive to temperature is shunted across the emitter and base circuits of the fourth transistor to vary the negative voltage to which the zener diode responds.

3. The battery condition indicator circuit defined in claim 1 wherein the red and green LEDs are combined in trichromatic arrangement to produce a yellow light in transition areas where both may be in a borderline state of operation between red only or green only.

4. In a battery charging and condition indicator system, a nickel cadmium storage battery, an alternating power source and a rectifier for transforming alternating current to direct current, and positive and negative lines through which direct current is supplied from the battery to an apparatus to which current is ordinarily supplied from the AC source to the rectifier in the event of a failure of the AC source, the improvement comprising:

(a) a main positive and a main negative line rectifier, the line from the rectifier being divided between the rectifier and the battery terminal into two main divisions, the first of which contains a fixed resistance comprising two sections in series, a normally open circuit comprising a time delay relay which, when the relay is energized, shunts out one of said two fixed resistances;

(b) a shunt circuit around said two fixed resistors which, along with the main negative line from the rectifier, lead directly to the respective positive and negative terminals of the battery through a voltage regulator, there being a diode in the positive line between the battery and the voltage regulator or the fixed resistors, the effect of which circuits is to connect the storage battery is parallel with the load instead of in series when said relay is energized.

5. In a battery charging system comprising a rectifier for converting alternating current to direct current and a battery having a positive pole connected with the positive terminal of the rectifier through a main line and having its negative terminal connected through a main line with the negative terminal of the rectifier, the improvement wherein:

(a) the positive line connecting the battery and the rectifier has a diode near its battery terminal preventing any reverse flow of current from the battery into said line, the line having two resistors in series between its ends with the two resistors both normally in the conducting length of the line between the rectifier and the diode;

(b) a shunt circuit around one of said resistors and the said positive line and the input terminal of the diode, said circuit including means for variably and intermittently withdrawing electrical energy from said line and, when so doing, it shorts out one of said series of two resistors; and (c) a second shunt circuit in the positive line around both resistors and, parallel with a negative line, both passing through a voltage regulator, the negative line continuing to the battery terminal, the battery in effect being then connected in parallel with the load represented by the said means for variably and intermittently withdrawing current from the battery, while said voltage regulator shunted around the load maintains a generally constant potential at the positive terminal of the battery.

6. In the battery charging circuit defined in claim 4, the combination wherein the shunt circuit around one of said two resistors comprises TDR-1 of a pump protective circuit and a ground circuit whereas the circuit from the positive pole of the battery is through TDR-2 of the same pump protective circuit to ground.

7. In the battery condition indicator circuit defined in claim 3, the main positive conductor into which [Z] is connected is that part of the circuit between the rectifier positive terminal and the two resistors and said shunt circuit and the main negative line is between the rectifier negative terminal and the battery.

* * * * *